US011289847B2

(12) United States Patent
Best

(10) Patent No.: US 11,289,847 B2
(45) Date of Patent: Mar. 29, 2022

(54) MODULAR CONNECTION BLOCK WITH A PLURALITY OF CONNECTION MODULES FOR AN ELECTRONIC COMPONENT

(71) Applicant: Phoenix Contact GmbH & Co. KG, Blomberg (DE)

(72) Inventor: Frank Best, Bueckeburg (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 116 days.

(21) Appl. No.: 16/647,534

(22) PCT Filed: Sep. 19, 2018

(86) PCT No.: PCT/EP2018/075342
§ 371 (c)(1),
(2) Date: Mar. 16, 2020

(87) PCT Pub. No.: WO2019/057767
PCT Pub. Date: Mar. 28, 2019

(65) Prior Publication Data

US 2020/0220295 A1 Jul. 9, 2020

(30) Foreign Application Priority Data

Sep. 19, 2017 (BE) ..... 2017/5661

(51) Int. Cl.
*H01R 13/514* (2006.01)
*H01R 13/518* (2006.01)
*H01R 12/71* (2011.01)

(52) U.S. Cl.
CPC ..... *H01R 13/518* (2013.01); *H01R 13/514* (2013.01); *H01R 12/71* (2013.01)

(58) Field of Classification Search
CPC .. H01R 13/639; H01R 13/516; H01R 13/518; H01R 13/514
(Continued)

(56) References Cited

U.S. PATENT DOCUMENTS 3,970,802 A * 7/1976 Nijman ..... H01R 13/518 379/325
4,032,209 A * 6/1977 Rutkowski ..... H01R 9/26 439/355
(Continued)

FOREIGN PATENT DOCUMENTS

CN 102084554 A 6/2011
CN 20332646 U 12/2013
(Continued)

*Primary Examiner* — Neil Abrams
(74) *Attorney, Agent, or Firm* — Leydig, Voit & Mayer, Ltd.

(57) ABSTRACT

A modular connection block includes: a plurality of electrical connection modules for conductor connection to an electronic component, the connection modules, in each case having a connection housing, being held together by holding means in an assemblage. The holding means include at least one strip-like connecting element, by which the connection housings are connected, the connection housings being arranged side by side along the strip-like connecting element in an in-line arrangement. The strip-like connecting element includes a plurality of spaced-apart connecting sections, from whose arrangement connection places are predetermined on the strip-like connecting element at which a respective connection module is connected or connectable to the strip-like connecting element by mechanical and/or frictional interlocking.

18 Claims, 14 Drawing Sheets

(58) Field of Classification Search
USPC ..... 439/532
See application file for complete search history.

(56) References Cited

U.S. PATENT DOCUMENTS

| | | | | |
|---|---|---|---|---|
| 4,090,764 | A * | 5/1978 | Malsby | H01R 13/514 439/471 |
| 6,361,374 | B1 * | 3/2002 | Lloyd | H01R 13/518 439/607.12 |
| 6,619,997 | B1 * | 9/2003 | Wilson | H01R 9/2416 439/371 |
| 7,488,202 | B2 * | 2/2009 | Spitaels | H01R 13/741 439/532 |
| 7,682,193 | B2 * | 3/2010 | Stoner | H01R 12/727 439/607.07 |
| 9,356,390 | B2 * | 5/2016 | Annis | H01R 13/6272 |
| 9,865,959 | B2 * | 1/2018 | Bertsch | H01R 13/514 |
| 10,340,624 | B2 * | 7/2019 | Schonfeld | H01R 13/518 |
| 10,396,488 | B2 * | 8/2019 | Wolffle | H01R 13/514 |
| 10,756,475 | B2 * | 8/2020 | Tiemann | H01R 13/6273 |
| 10,892,572 | B2 * | 1/2021 | Diessel | H01R 9/2675 |
| 11,038,304 | B2 * | 6/2021 | Tiemann | H01R 13/745 |
| 2016/0276786 | A1 | 9/2016 | Herbrechtsmeier | |
| 2017/0237209 | A1 | 8/2017 | Loetkemann et al. | |
| 2020/0220295 | A1 * | 7/2020 | Best | H01R 13/514 |

FOREIGN PATENT DOCUMENTS

| | | | |
|---|---|---|---|
| DE | 102009013689 | A1 | 9/2010 |
| DE | 202013103611 | U1 | 9/2013 |
| DE | 102014215809 | A1 | 2/2016 |
| EP | 0742608 | A1 | 11/1996 |
| EP | 2312700 | A1 | 4/2011 |
| JP | 2000156252 | A | 6/2000 |
| JP | 2002305828 | A | 10/2002 |
| NL | 1019122 | C2 | 4/2003 |
| WO | WO 2015085994 | A1 | 6/2015 |

* cited by examiner

MODULAR CONNECTION BLOCK WITH A PLURALITY OF CONNECTION MODULES FOR AN ELECTRONIC COMPONENT

CROSS-REFERENCE TO PRIOR APPLICATIONS

This application is a U.S. National Phase application under 35 U.S.C. § 371 of International Application No. PCT/EP2018/075342, filed on Sep. 19, 2018, and claims benefit to Belgian Patent Application No. BE 2017/5661, filed on Sep. 19, 2017. The International Application was published in German on Mar. 28, 2019 as WO 2019/057767 under PCT Article 21(2).

FIELD

The invention relates to a modular connection block comprising a plurality of connection modules, which are used for conductor connection to an electronic component. Here the connection modules each have a connection housing, these being held together in an assemblage by holding means in order to form the connection block.

BACKGROUND

Modular connection blocks of the type in question serve to provide on the connection housings connection points for the conductor connection in order to connect electrically or to be able to connect electrically an electrical conductor connected thereto to an electronic component arranged on the connection housing.

In order to form a connection point, at least one electrical connection element is accommodated in the connection housing, which can be designed in various ways in order to electrically connect a conductor connected thereto to the electronic component.

Furthermore, the connection housings can be designed in various ways and, for example, configured and formed for a plug-in connection for connecting a conductor to an electronic component. The electrical connection element can therefore be configured and formed at the connection point for example and in particular to form a spring-loaded terminal connection, screw connection or plug-in connection. Likewise, the electronic component can be contacted by means of a plug-in connection, for which purpose the connection housing is configured and formed accordingly.

Modular connection blocks of the type in question are known, for example, from EP 0742 608 A2 as also from JP 2000156252 A1, in which the connecting means provide a closed holding frame for forming an assemblage consisting of a plurality of connection blocks. Insertion slots for the connection housings are formed thereon, into which insertion slots they are inserted and are held in the assemblage by latching with the holding frame.

Furthermore, modular connection blocks of the type in question are known from DE 10 2009 013 689 A1 or EP 2 312 700 A1, in which the connecting means has an arcuate securing element which reaches around the in-line arrangement of a plurality of connection housings in a clamp-like manner and thus secures their assemblage. EP 2 312 700 A1 as also JP 2002 305828 provides a holding frame on which the connection housings are first arranged and finally held on the holding frame by means of clamp-shaped connecting means.

One limitation of these modular connection blocks, however, is that the holding frame determines the type and number of connection housings that can be used to form a connection block.

Furthermore, modular connection blocks of the type in question are also known from DE 103 09 965 A1, wherein the connection housings are shaped in such a way that they can be plugged together directly to form an assemblage. Modular connection blocks formed in this way make it possible to connect any number of connection modules to each other. For this purpose, however, the designs of the individual connection modules must be coordinated with each other in order to form such an assemblage, as a result of which geometric restrictions arise in the design or mutual spacing of the connection housings.

SUMMARY

In an embodiment, the present invention provides a modular connection block, comprising: a plurality of electrical connection modules for conductor connection to an electronic component, the connection modules, in each case having a connection housing, being held together by holding means in an assemblage, wherein the holding means comprise at least one strip-like connecting element, by which the connection housings are connected, the connection housings being arranged side by side along the strip-like connecting element in an in-line arrangement, and wherein the strip-like connecting element comprises a plurality of spaced-apart connecting sections, from whose arrangement connection places are predetermined on the strip-like connecting element at which a respective connection module is connected or connectable to the strip-like connecting element by mechanical and/or frictional interlocking.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

Figure 1:
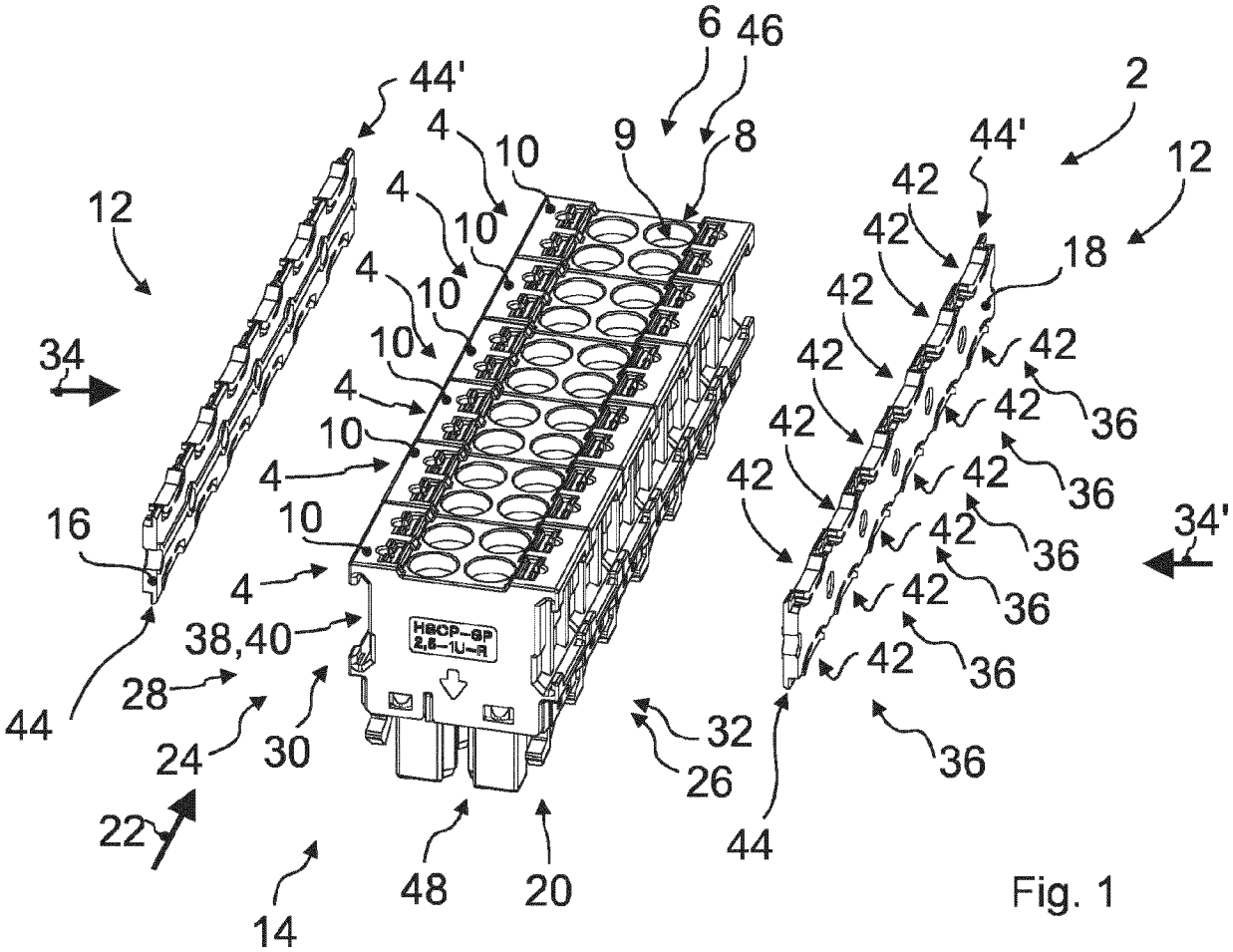
FIG. 1 a first exemplary embodiment of a connection block according to the invention in a perspective view in a schematic representation, with an in-line arrangement of a plurality of connection modules which are held together in the assemblage by means of the strip-like connecting elements shown and spaced apart for the in-line arrangement, FIG. 2 the first exemplary embodiment of a connection block according to the invention from FIG. 1 with the strip-like connecting elements arranged in an initial position on the in-line arrangement, in the same mode of representation as in FIG. 1, FIG. 3 the first exemplary embodiment of a connection block according to the invention from FIG. 2 in a further perspective side view in otherwise the same mode of representation as in FIG. 2, FIG. 4 the first exemplary embodiment of a connection block according to the invention from FIG. 1 with the strip-like connecting elements arranged in an initial position on the in-line arrangement, in the same mode of representation as in FIG. 2, FIG. 5 the first exemplary embodiment of a connection block according to the invention from FIG. 4 with the strip-like connecting elements arranged in a final position on the in-line arrangement, in a further perspective side view in an otherwise identical mode of representation as in FIG. 4, FIG. 6 *a*) the first exemplary embodiment of a connection block according to the invention from FIG. 2, in a viewing direction indicated by A in FIG. 2, otherwise in the same mode of representation as in FIG. 2.
Figure 2:
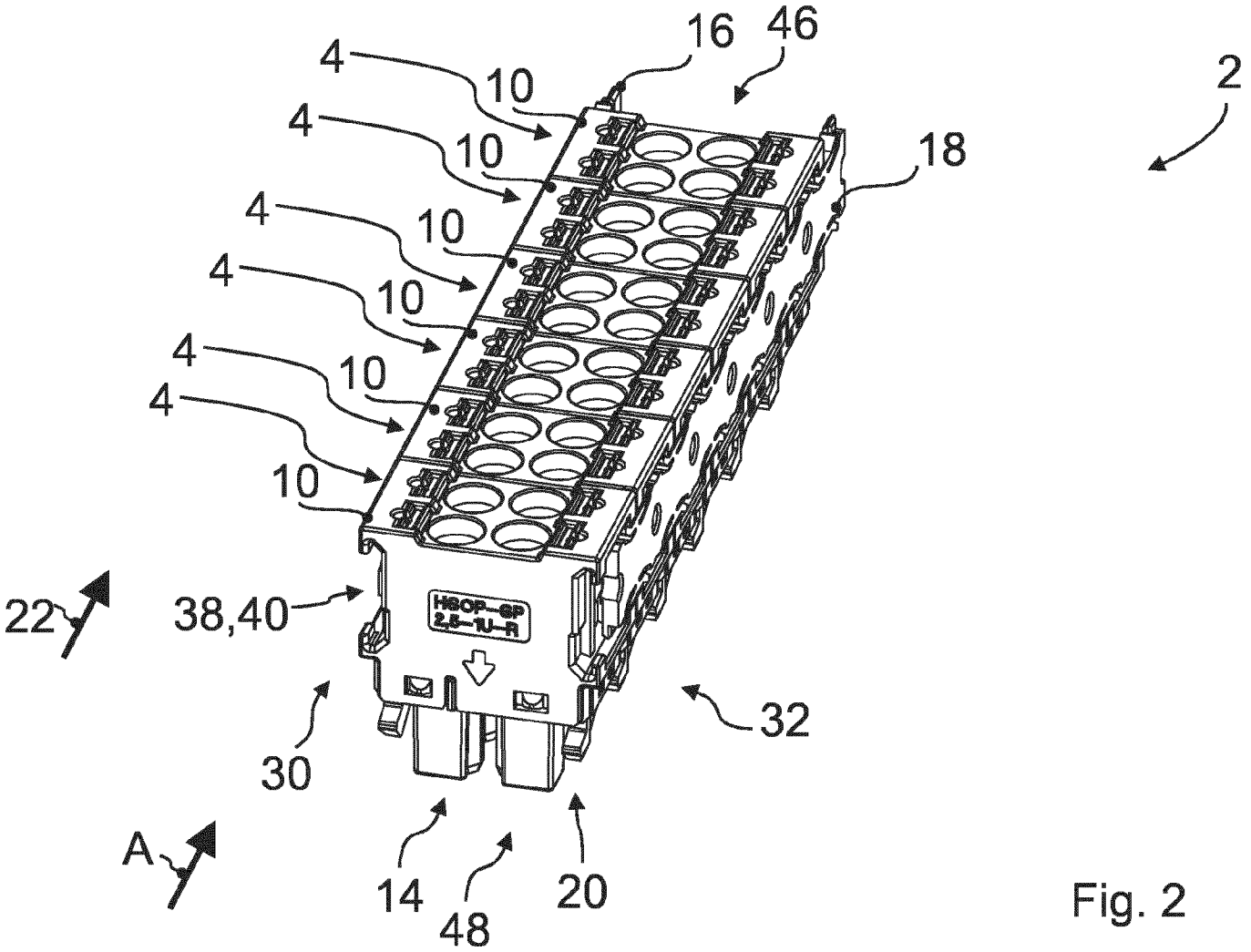
Figure 4:
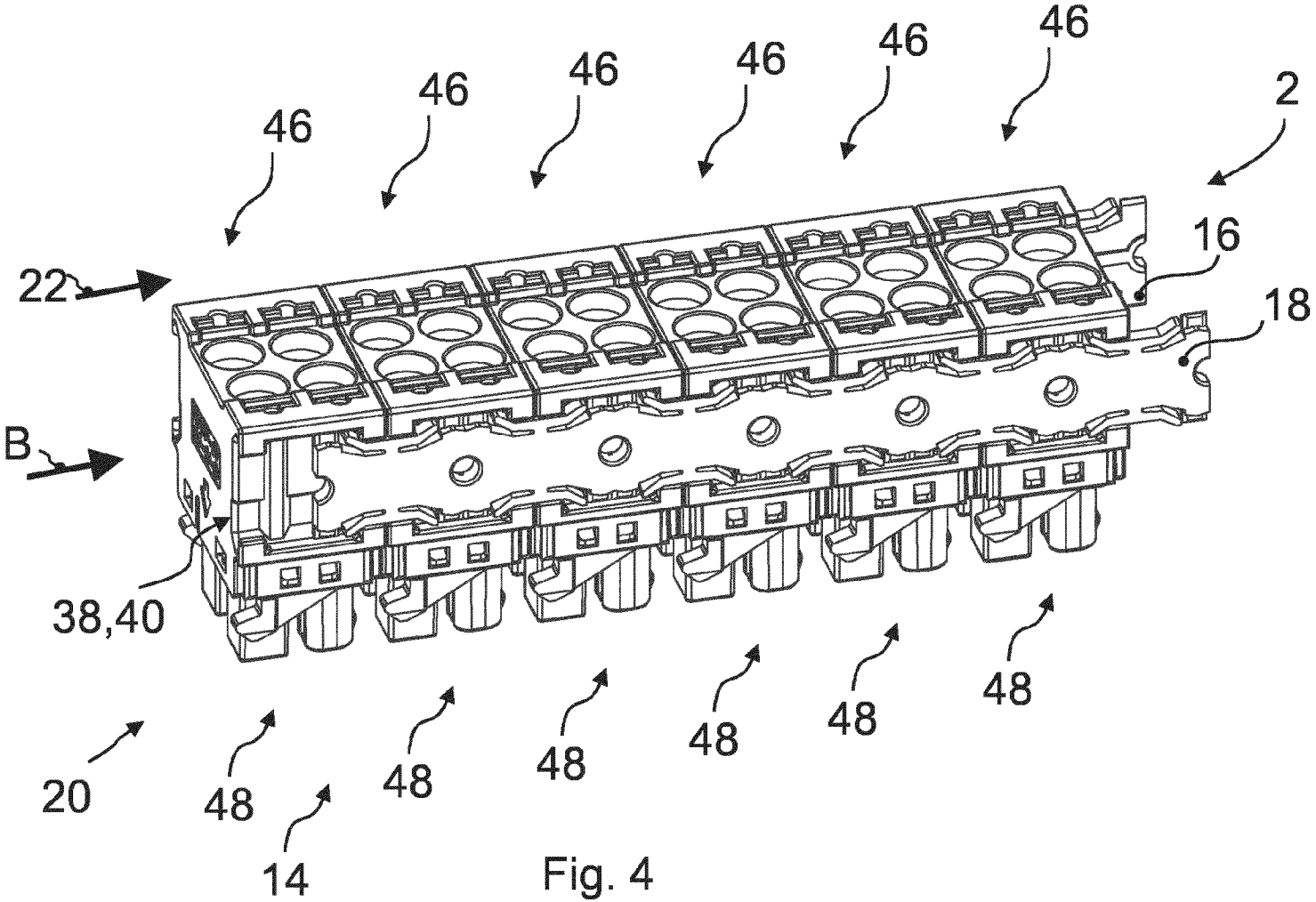
Figure 7:
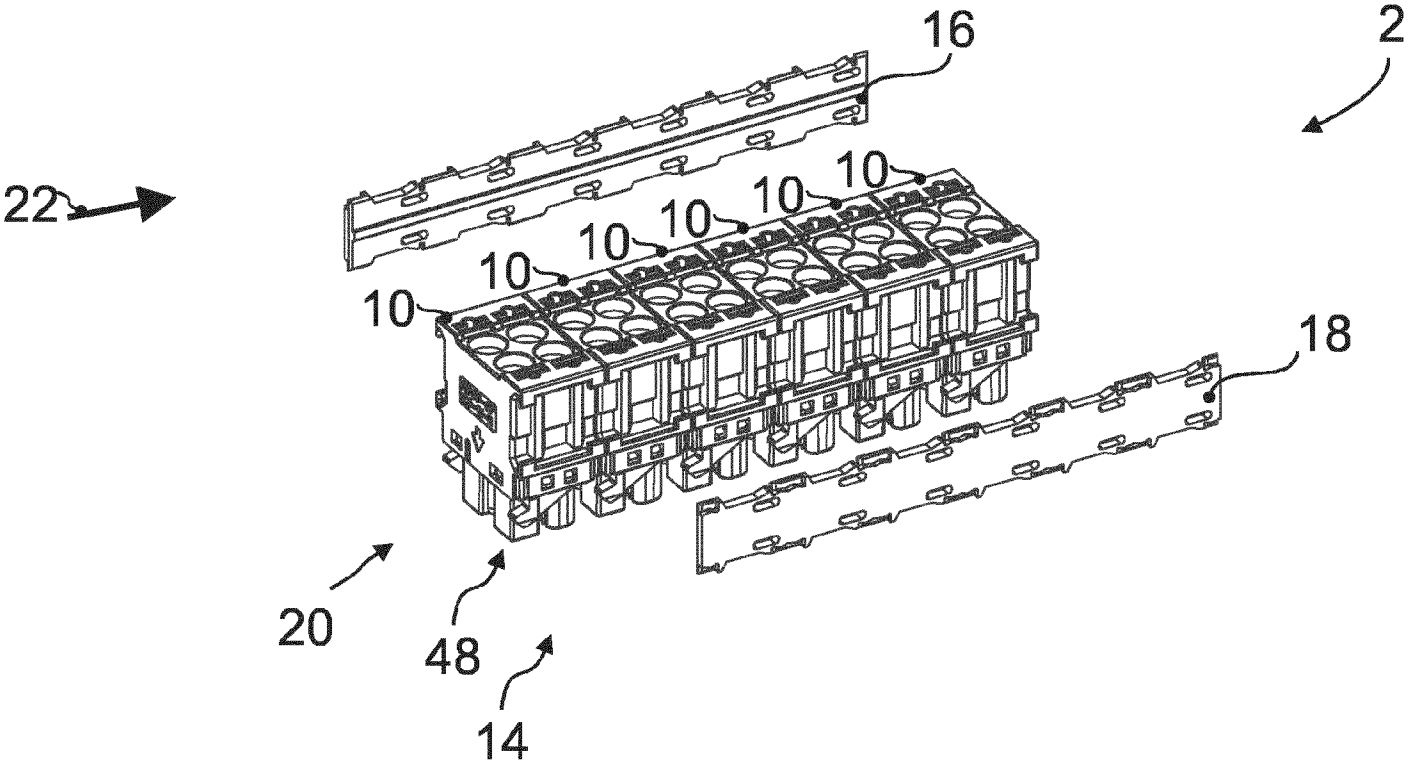
Figure 8:
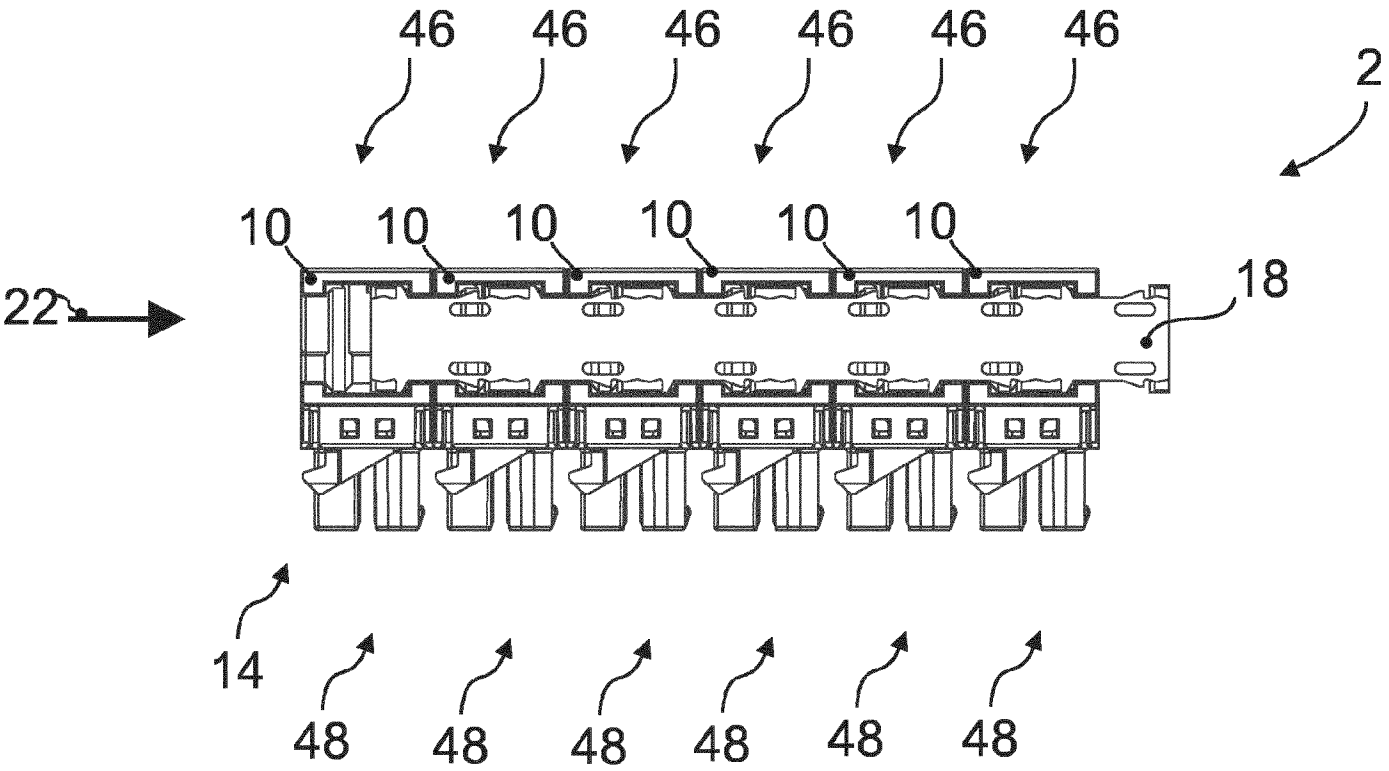
Figure 9:
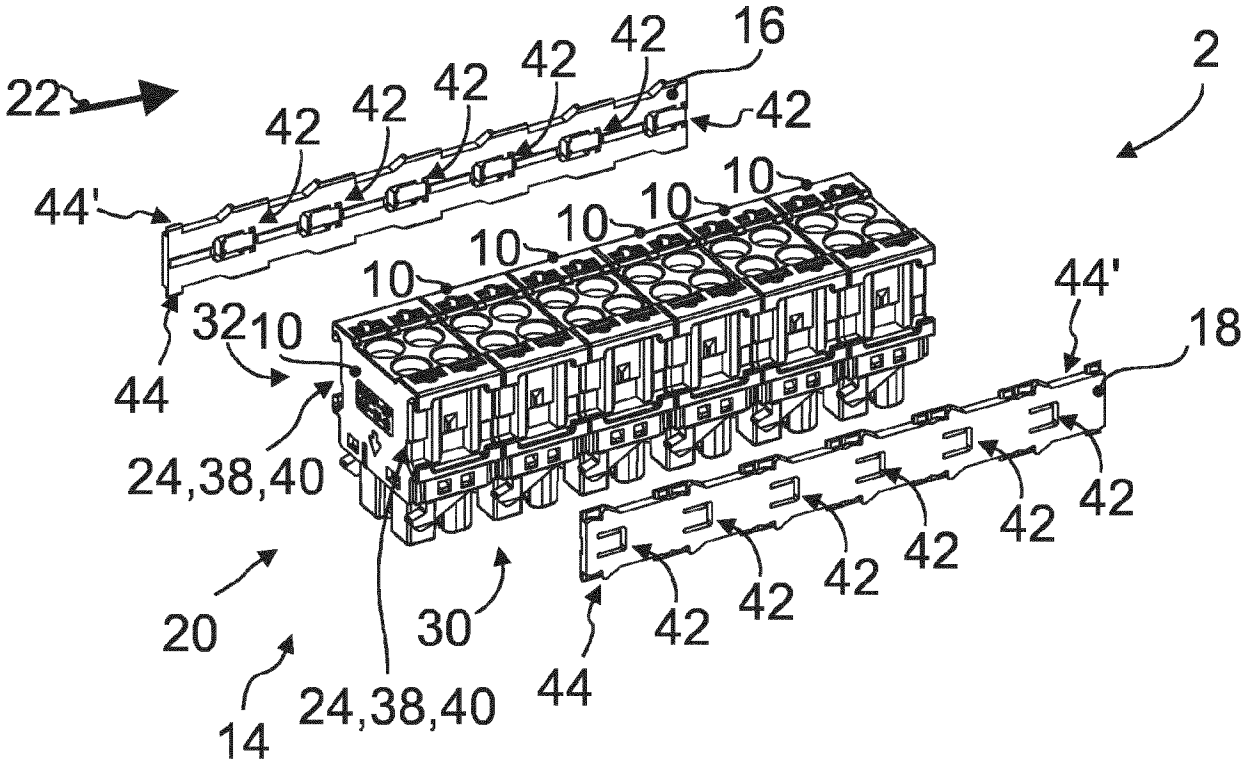
Figure 10:
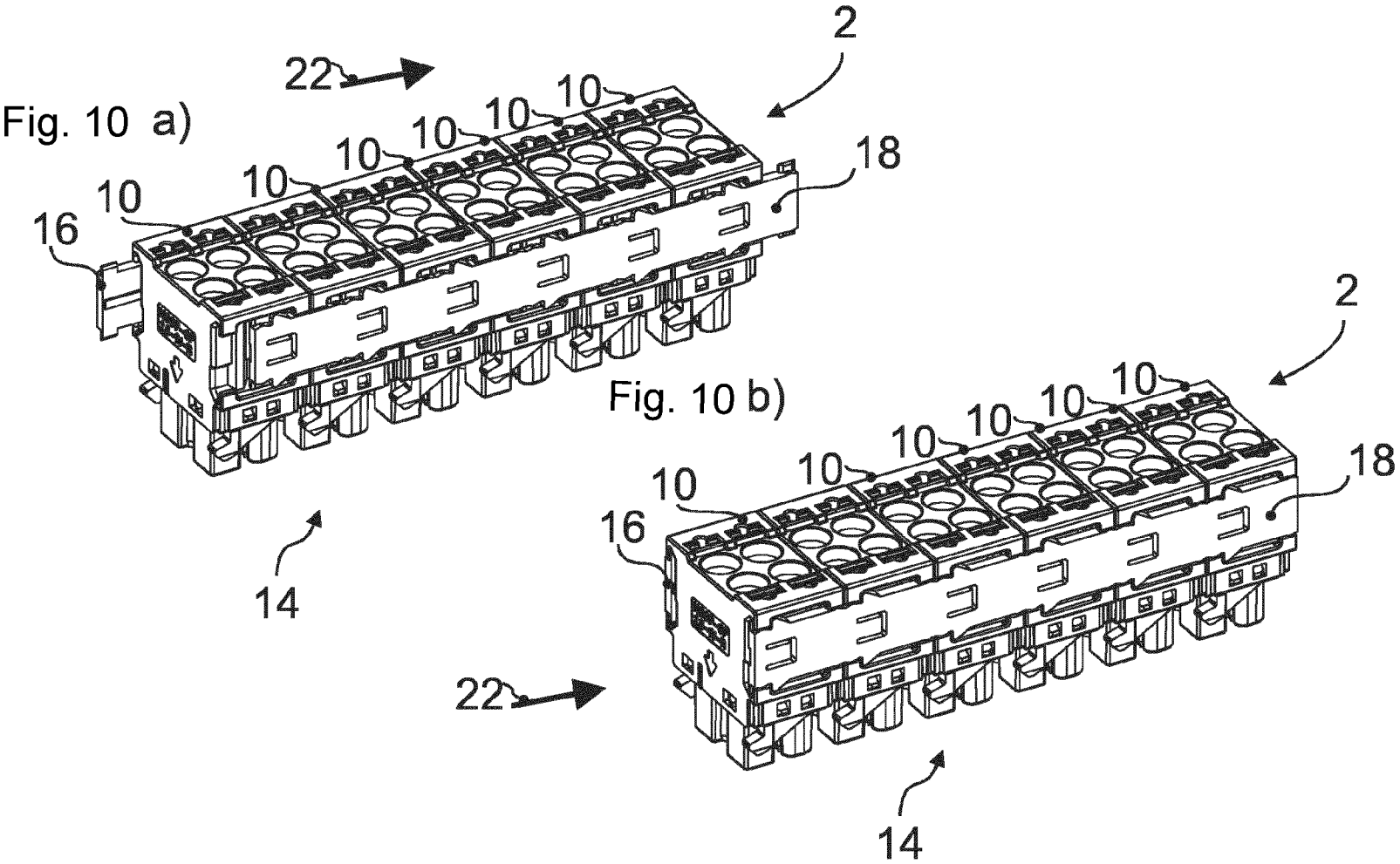
Figure 11:
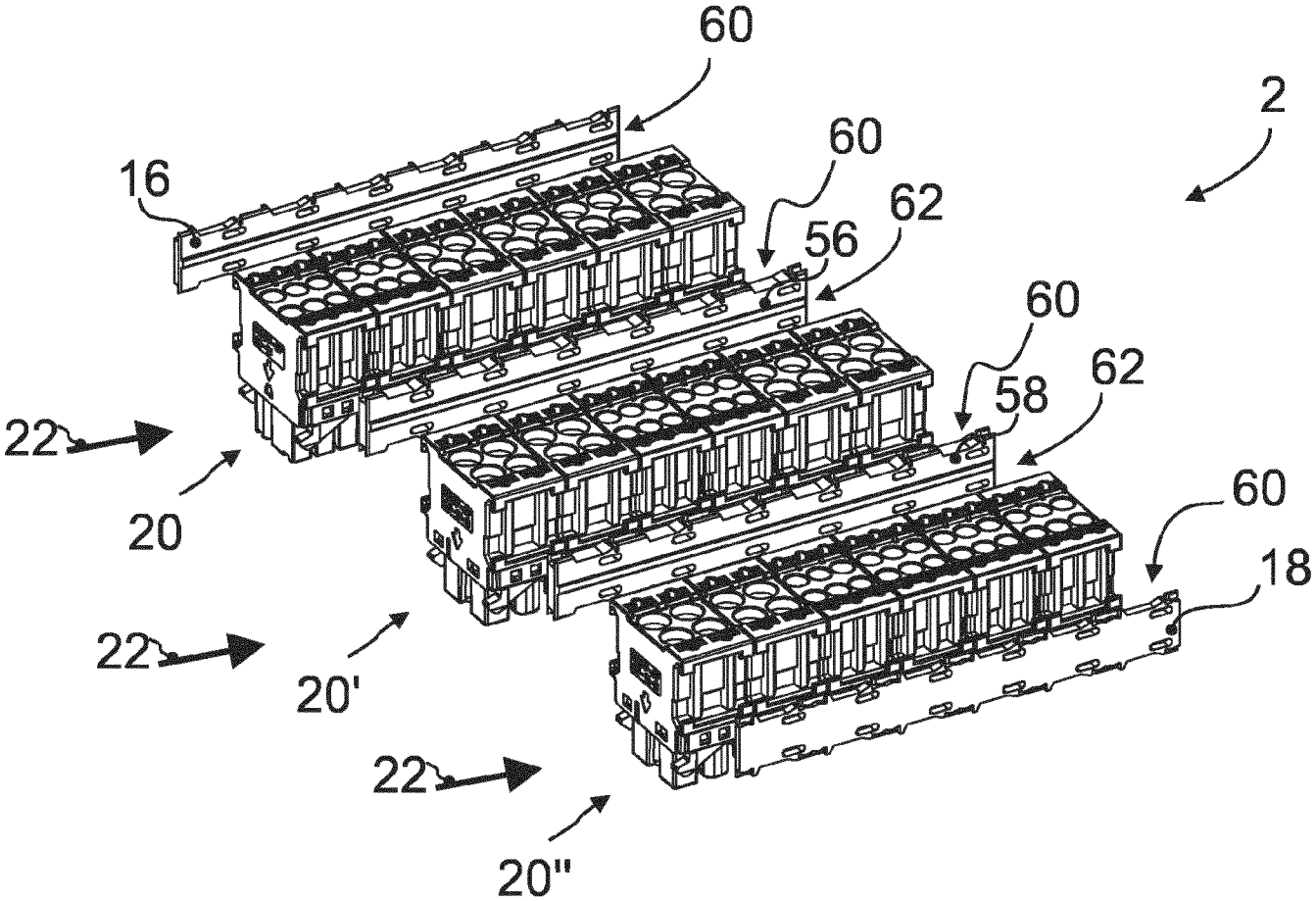
Figure 12:
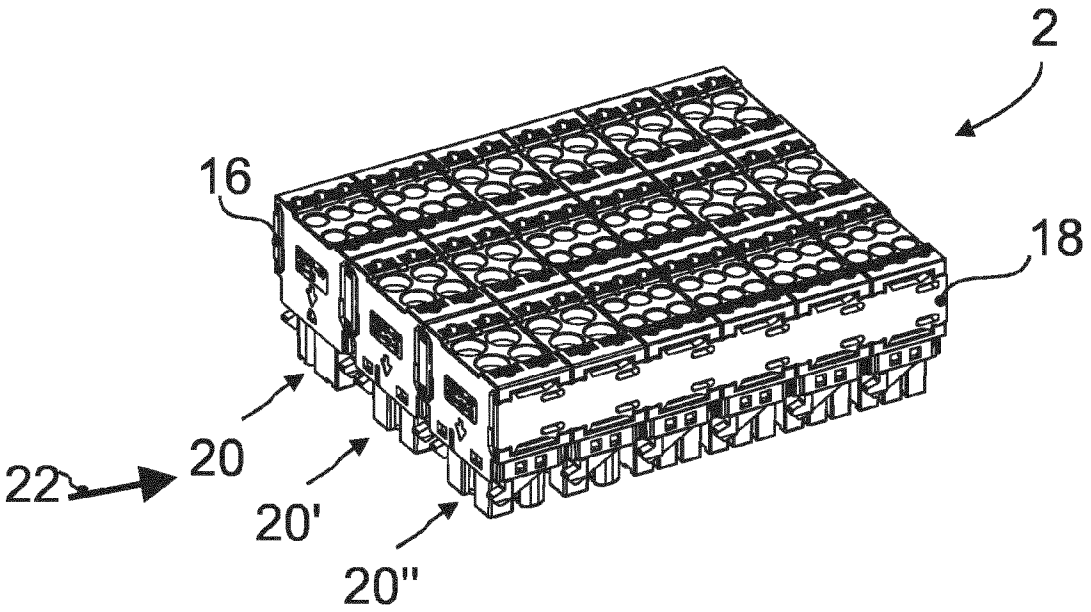
Figure 13:
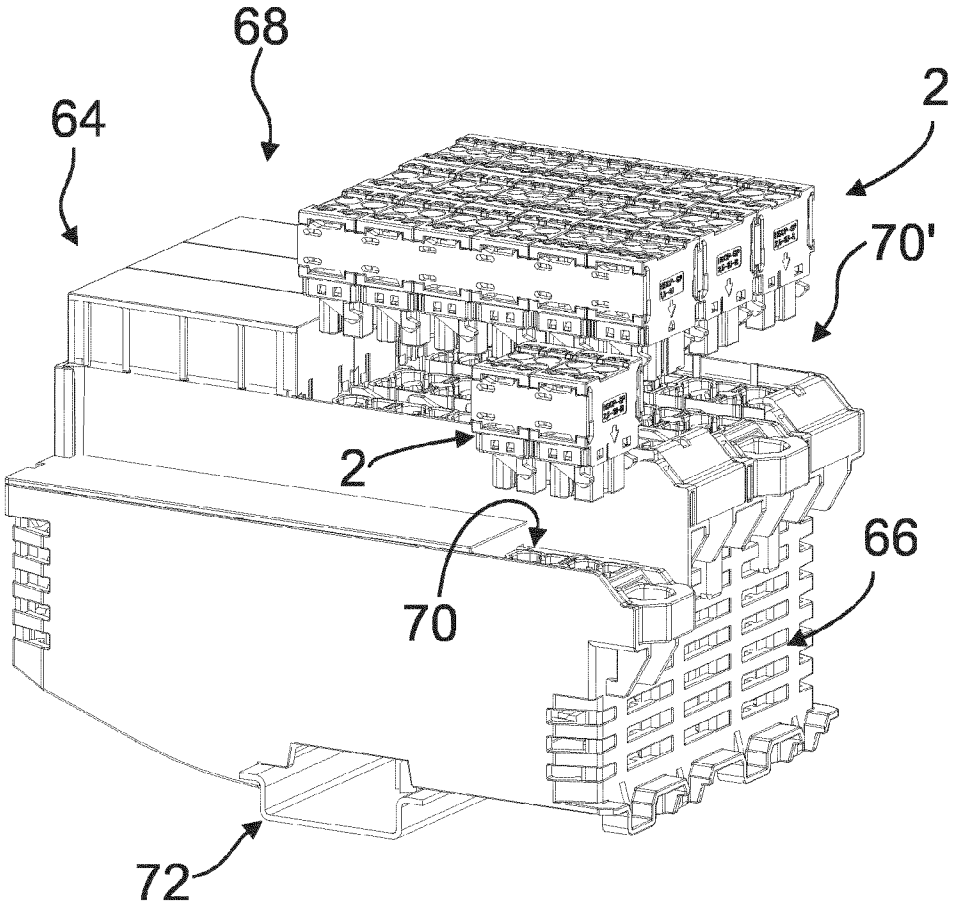

*b*) the first exemplary embodiment of a connection block according to the invention from FIG. 4, in a viewing direction indicated by B in FIG. 4, otherwise in the same mode of representation as in FIG. 4, FIG. 7 the first exemplary embodiment of a connection block according to the invention from FIG. 1 in a further perspective side view in otherwise the same mode of representation as in FIG. 1, FIG. 8 the first exemplary embodiment of a connection block according to the invention from FIG. 2 in a side view in an otherwise identical mode of representation as in FIG. 2, FIG. 9 a second exemplary embodiment of a connection block according to the invention in a perspective view in a schematic mode of representation, analogous to the representation in FIG. 1, FIG. 10 *a*) the second exemplary embodiment of a connection block according to the invention from FIG. 9 with the strip-like connecting elements arranged in an initial position on the in-line arrangement, otherwise in the same mode of representation as in FIG. 9,

*b*) the second exemplary embodiment of a connection block according to the invention from FIG. 9 with the strip-like connecting elements arranged in a final position on the in-line arrangement, in which the strip-like connecting elements hold the connection housings in the grouping, in otherwise the same mode of representation as in FIG. 9, FIG. 11 a third exemplary embodiment of a connection block according to the invention in a perspective view in schematic representation, in which the strip-like connecting elements are shown at a distance from the connection housings arranged in two in-line arrangements, FIG. 12 the third exemplary embodiment of a connection block according to the invention in the same perspective view as in FIG. 11 in schematic representation, in which the strip-like connecting elements are in a final position, in otherwise the same mode of representation as in FIG. 11, FIG. 13 an application example in a perspective view in schematic representation with a connection block according to the invention, which is formed in the manner of a first exemplary embodiment from FIG. 1, and a further connection block, which is formed in the manner of a third exemplary embodiment from FIG. 11, the two connection blocks being inserted into an electronics housing from which they are shown at a distance in FIG. 13.

Figure 14:
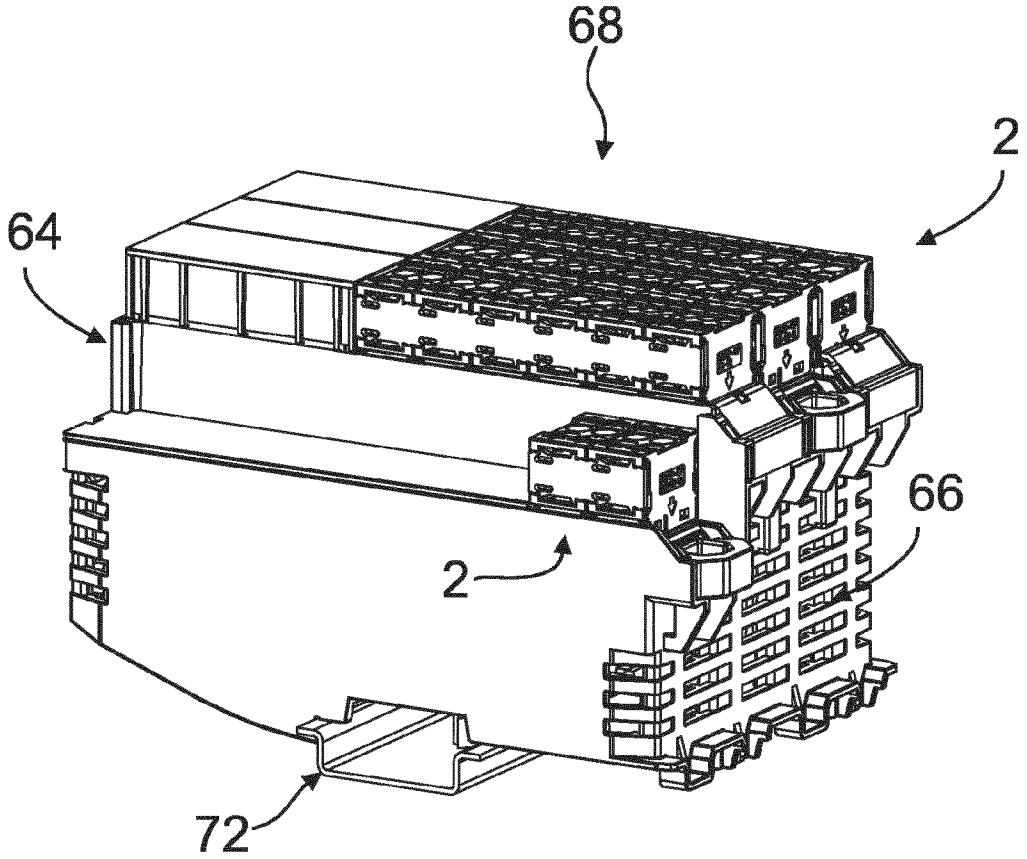

FIG. 14 the exemplary embodiment of FIG. 13 in the same perspective view as in FIG. 13 in schematic representation, in which the connection blocks according to the invention are used in an electronics housing.

DETAILED DESCRIPTION

In an embodiment, the present invention provides a modular connection block with a plurality of connection modules in order to form a conductor connection on an electronic component, in which the limitations of modular connection blocks known from the prior art are avoided and a simple creation of a connection block having any number of connection modules held together in the assemblage is made possible.

In an embodiment, the present invention moves away from the idea of providing adaptation means for adapting the individual connection modules in such a way that they are made mutually compatible in order to form a connection block.

Furthermore, the invention is based on the idea of providing a plurality of different connecting means in order to be able to combine various types of connecting module with each other and to connect them to each other to form an assemblage.

Instead the invention solves the it is presented with by the holding means having at least one strip-like connecting element to which the connection housings are connected, the connection housings being arranged next to each other along the strip-like connecting element in an in-line arrangement.

Furthermore, the invention provides for the strip-like connecting element to have a plurality of connecting sections which are spaced apart from each other and, due to their arrangement, connection places are predefined on the strip-like connecting element, the connecting sections being configured and formed in such a way that on a respective connecting section one of the connection modules is or can be connected to the strip-like connecting element by mechanical and/or frictional interlocking. Here, latching means according to the invention are provided which are configured and formed for a mechanically and/or frictionally interlocking connection between the connection housing and the strip-like connecting element.

According to the invention, a connection housing of a connection module preferably is or can be assigned in each case to a connecting section.

The strip-like connecting element according to the invention has free ends between which the connection housings are or can be arranged next to each other. Here the connection housings are preferably arranged with a uniform orientation.

The invention dispenses with the use of a frame by means of which the connection housings would be enclosed in the circumferential direction. Furthermore, the invention eschews having the connection housings in their in-line arrangement reaching around in a clamp-like manner in order to be able to hold them together in the assemblage. Instead, according to the invention, at least one strip-like connecting element serves to connect the connection housings to each other in a frameless or clamp-free manner in order to form the connection block, in that said element extends preferably in a planar manner along the connection housings that are arranged next to each other.

According to the invention, the strip-like connecting element is a separate element which extends longitudinally between its free ends. According to the invention, the strip-like connecting element is arranged only on one side of the connection housing of a particular connection module, as a result of which a simple adaptation of the length of the strip-like connecting element to the number of connection modules to be connected to each other is possible.

In the context of the invention, the strip-like connecting element preferably extends longitudinally or in a straight line. Furthermore, according to the invention, it is preferably flat and therefore has a small thickness, as a result of which it requires little space.

As previously stated, the strip-like connecting element has a side on which the connection modules can be arranged and connected. The aforementioned thickness of the strip-like connecting element is thus transverse to this side.

Here the at least one strip-like connecting element is arranged only on one side of the connection housing of each connection module in order to connect this connection housing to further connection housings. This secures a high degree of design freedom for the connection housings.

In the case of a modular connection block according to the invention, the connection housings can have almost any design and therefore do not necessarily have to be formed identically to each other or uniformly.

An advantage of the invention thus lies in the fact that different types of connection modules can also be connected to each other by the at least one strip-like connecting element so as to form a connection block even with connection housings of different designs.

Hereinafter a modular connection block according to the invention will also be referred to for short as a connection block.

Furthermore, the invention has the advantage that the number of connection housings held together in an in-line arrangement in the assemblage in order to form a connection block is not limited by the strip-like connecting element, in particular by its design. The length of the strip-like connecting element along which the connection modules are arranged in a row and connected to each other can, according to the invention, be adapted to the number of connection modules by, for example, a simple cutting to length. This cutting to length can also be carried out at a point in time after the connection modules have been connected to the strip-like connecting element.

The length of the strip-like connecting element depends in fact on the number of connection modules or connection housings which are provided for forming a connection block according to the invention. In the simplest case, a connection block comprises two connection modules which are arranged next to each other.

The invention therefore advantageously makes it possible to combine connection modules of different designs, functions and also with different connection points, whereby a high variability in the formation of a connection block is achieved. The invention thus opens up a wide range of applications.

In order to be able to arrange the connection modules or their connection housings in a simple manner on the strip-like connecting element, connection places are formed by the connecting sections. This makes it possible for the connection modules or their connection housings to be arranged on the strip-like connecting element in a position prespecified by their respective connection place without a special alignment/placement effort being necessary.

Furthermore, apart from the strip-like connecting element, no further connecting elements are absolutely necessary, which also yields advantages in terms of the effort involved in realizing a connection block.

The connection block therefore makes it possible for the connection housings to be arranged very close to each other and to be held together in the assemblage, whereby the space requirement can be kept to a minimum.

According to the invention, variant creation or the combination and arrangement of the connection housings can take place at a late stage of production, thereby achieving a high degree of flexibility and adaptability in the formation of a connection block.

Furthermore, it is also possible to reduce the number of connection modules in a connection block formed according to the invention even after its production by cutting through the at least one strip-like connecting element at the appropriate location. Furthermore, it is possible for the strip-like connecting element to be freely adjustable in length by being cut to the desired length in a simple manner. For this purpose, separating aids, such as separating lines, slots or perforations, can also be provided on a strip-like connecting element at appropriate intervals.

The invention also offers the advantage that putting together the plurality of connection modules can be carried out at a very late stage of production. The flexible assembly and arrangement of the end housings of the connection housings thereby provides a connection block with a flexible configurability. Connection blocks according to the invention can also be produced in extremely small production batches.

The invention also makes it possible to adapt a connection block according to the invention in a simple manner, for example by cutting through the strip-like connecting element, even when it has been fitted with connection housings, and thus making it possible to reduce the number of connection housings.

In addition, the invention makes it possible for the connection housings of a particular connection module to be arranged as required. Here the order in which the connection modules are arranged next to each other is arbitrary.

The invention thus advantageously leads to greater degrees of freedom with regard to the design and in-line arrangement of the connection modules.

The invention takes into account that further bodies, which can serve, for example, as spacers or gap fillers, can also be arranged between the connection modules instead of connection housings.

In a connection block according to the invention, each connection housing is connected individually to the strip-like connecting element so that a high connection reliability can be achieved. In this way, even relatively large distances separating the connection housings are also possible, the connection housings preferably being arranged as close as possible to each other for a small space requirement. For this reason the distance between two adjacent connection housings can be kept to a minimum or the connection housings can be arranged abutting onto each other, whereby this distance is reduced to zero or almost to zero. Here it is also provided that the connection housings in the in-line arrangement and arrangement on the strip-like connecting element touch each other.

The invention makes it possible to attach the connection modules in a simple manner to the strip-like connecting element and to hold them securely in the place provided for this purpose at a connection place.

Within the scope of the invention, an electronic component is preferably and in particular a printed circuit board or an arrangement of printed circuit boards on which a conductor connection can be realized by means of a connection block. An electronic component can therefore also be an electronic device with a printed circuit board or an arrangement of printed circuit boards on which a connection block for forming a conductor connection can be arranged.

For the conductor connection, a connection housing has one or a plurality of connection points, at which the connection of conductors is provided so as to be able to connect these electrically to an electronic component.

In this case, a conductor can in particular be an uninsulated end of an electrical wire of a cable, on which, for example, a wire end ferrule can also be arranged, as is customary with electrical wires formed from strands.

The strip-like connecting element can be connected in different ways to the respective connection housings of the connection modules.

Here each of the connection housings is preferably connected to the strip-like connecting element in the same way.

However, the invention is not limited thereto, so that the connection housings can be connected in different ways to the strip-like connecting element.

For connecting a connection housing to the strip-like connecting element, it is provided in an advantageous further development of the invention that the connection housing has at least one receptacle for the strip-like connecting element, wherein the receptacle and the strip-like connecting element or its respective connecting section are configured and formed in correspondence with each other in such a way that the connection housing of each connection module is or can be connected in a mechanically and/or frictionally interlocking manner to the strip-like connecting element.

An advantage associated with the aforementioned further development is that the invention makes a tool-free connection of the connection housing of a connection module possible to the strip-like connecting element. Furthermore, a high stability of the connection is thus attainable.

Furthermore, the invention permits a non-destructive removal of a connection housing from the strip-like connecting element.

In this context, the invention also provides for the connection housing to be connected to the strip-like connecting element by frictional interlocking. Here the invention also encompasses any combination of the connection types. In particular, a mechanically and/or frictionally interlocking connection between connection housing and strip-like connecting element advantageously permits a non-destructive separation of the assemblage and a corresponding removal of connection modules or corresponding removal of the at least one strip-like connection element from one, more or even all of the connection modules of a connection block.

Furthermore, in particular by means of a mechanically and/or frictionally interlocking connection, the advantage arises that the arrangement of the connection modules can be changed or connection modules exchanged or replaced by other connection modules. The invention thus makes it possible to easily change the arrangement of the plurality of connection modules in the case of a connection block designed according to the invention.

Here the invention also makes it possible, for example, to replace one connection module with another.

This thus also leads to advantages in handling, maintenance as well as in recycling and in adaptability to different or changing requirements.

In addition, according to the invention, a bonded connection between the strip-like connecting element and the connection housing can also be provided, for example by means of an adhesive which is applied between the strip-like connecting element and the connection housing. Furthermore, an adhesive can secure the assemblage of connection housings in its composition against an undesired removal of connection modules and, if applicable, make it inseparable. Tamper-proofing is thus achieved in a manner both cost-effective and simple.

Liquid adhesives which, after application, produce a bonded connection between the strip-like connecting element and the connection housing, can be used as bonding means. Furthermore, a bonded connection can also be achieved by the use of adhesive strips. In addition, a bonded connection can be achieved by welding, for example and in particular by means of ultrasonic welding or laser beam welding, wherein the connection housing of a respective connection module and/or the strip-like connecting element is/are configured and formed accordingly.

The use of adhesives leads to a firm connection between connection housing and strip-like connecting element, which cannot, for example and in particular, be released non-destructively.

The connection housings of the connection modules have a body section which is formed between a head section for the conductor connection and a foot section for contacting the electronic component. The receptacle for the strip-like connecting element is preferably formed on a body side of the body section which, in the case of an in-line arrangement of the connection housings, faces outwards and is transverse to a lining-up direction in which the connection housings are arranged side by side on the strip-like connecting element.

In the context of the invention, a lining-up direction is one in which the corresponding connection housings of the plurality of connection modules are arranged or lined up next to each other so as to form an in-line arrangement in which they are held together by the at least one strip-like connecting element.

Against this background, a further advantageous development of the invention takes into account the fact that the receptacle is arranged on a body side of the connection housing.

Associated with this is the advantage that the connection of the individual connection housings to each other does not impair the formation of conductor connections or the creation of the contacting of the electronic component. Furthermore, this results in handling advantages.

According to the invention, the strip-like connecting element can be arranged on the connection housings in many ways.

For this purpose, for example and in particular, it is provided within the scope of the invention that a connection module with its connection housing transverse to the strip-like connecting element can be attached to said strip-like connecting element in order to arrange it on said strip-like connecting element for a connection thereto.

Furthermore, it is provided according to the invention, for example and in particular, that a relative movement transverse to the direction in which the connection housing of the connection module is applied to the strip-like connecting element brings about a mechanically and/or frictionally interlocking connection between the strip-like connecting element and the connection housing.

In this way, within the scope of the invention, there occurs in particular an application of the connection housing to the strip-like connecting element in one direction and a movement for a mechanically and/or frictionally interlocking connection to each other in a direction transverse thereto.

For this purpose, it is provided in another advantageous further development of the invention that the receptacle be configured and formed in such a way that, for an arrangement of the connection housing on the strip-like connecting element, the strip-like connecting element can be attached to the receptacle in a direction transverse to the body side.

The strip-like connecting element and the receptacle of the connection housing can thus also be guided towards each other along a surface normal of the body side or face.

This leads to the advantage that the strip-like connecting element with its one free end does not have to be guided along all of the connection housings which serve to form a connection block according to the invention, thereby resulting in handling advantages when forming a connection block according to the invention. Furthermore, it is possible according to the invention to connect the connection housings in the in-line arrangement at the same time to the strip-like connecting element, as a result of which further time and cost advantages are realized in the production of a connection block according to the invention.

The invention makes it possible for the connection modules to be connected to the strip-like connecting element independently of each other but as it were simultaneously in order to form a connection block.

In order to be able to connect the connection housings to the strip-like connecting element, the strip-like connecting element has a plurality of connecting sections, wherein in each case a connection housing is assigned to at least one connecting section, as is provided in a further advantageous development of the invention.

The connection section in question serves to connect the connection housing to the strip-like connection element, a connection section being assigned in particular to one connection housing in each case. This is the case, for example and in particular, when the external dimensions of the connection housings or the body sections of the respective connection housings in the aforementioned lining-up direction have the same dimensions relative to each other.

Within the scope of the invention, the connecting sections along the strip-like connecting element are spaced apart and in particular are of uniform design. It is thus possible for the plurality of connection housings in the assemblage to be arranged with each other in any order on the strip-like connecting element and to be connected thereto.

The development leads to the locations provided for connecting the respective connection housing to the strip-like connecting element permitting an in-line arrangement of the connection housing with prespecified distances between them. Associated with this is firstly the advantage that the connection housings in the in-line arrangement are arranged side by side at prespecified distances which are determined by the strip-like connecting element. This simplifies the mutual alignment of the connection housings. Furthermore, it is thereby possible to secure the mutual compatibility of the connection housings in order to form an assemblage. This leads to easier handling when manufacturing a connection block.

Building onto these inventive concepts, according to a further advantageous development of the invention it is determined that the connecting sections be spaced apart at equal intervals along the strip-like connecting element, whereby the connection housings can advantageously likewise be arranged at equal distances from each other or can be or are arranged at predetermined locations in the manner of a grid.

By a further advantageous further development, the invention makes it possible for the connecting section and the receptacle to be configured and formed relative to each other for a guided translational movement in such a way that it can be moved between an initial position, in which the respective connection housing is arranged on the strip-like connecting element but is unconnected thereto, and a final position, in which the connection housing in question is connected to the strip-like connecting element.

The invention thus makes it possible for each connection housing to be connected to the strip-like connecting element by a translational movement between them. The invention thus makes it possible to connect the connection housing of a connection module to the strip-like connecting element by means of a translational movement in the lining-up direction, in which the connection housings of the connection modules are arranged next to each other to form a modular connection block according to the invention, which is significantly less than the width of the connection housing in question that is dimensioned in the lining-up direction.

For this purpose, it is provided that the connecting section and the receptacle be configured and formed for a translational movement by the connection housing and the strip-like connecting element relative to each other between an initial position, in which the respective connection housing is unconnected to the strip-like connecting element, and a final position, in which the connection housing in question is connected to the strip-like connecting element.

Tools for producing the connection are therefore unnecessary. For further simplification, the connection housings can first be arranged side by side in order to then be connected together to the strip-like connecting element in the manner described above. Not only handling advantages but also time advantages arise thereby.

In order to be able to hold the connection modules securely against each other, in a further advantageous development of the invention provision is made for the receptacle of the connection housing and/or of the connection sections of the strip-like connecting element to have latching means which are configured and formed for latching together the connection housing and the strip-like connecting element.

The invention thus enables a connection block to be formed without the use of tools. In addition, such a formation can also take place without auxiliary means, so that, for example, adhesives or a bonded connection can be dispensed with.

In addition, the invention also allows tool-free separation of the assemblage of connection modules or a simple reduction in the number of connection modules.

According to the invention, the connection housings in their in-line arrangement are detachably connected by the latching means to the strip-like connecting element, preferably non-destructively. The invention is not limited to this, so that the connection housings can also be fixedly connected to the strip-like connecting element by means of the latching means in such a way that the assemblage cannot be separated without permanent damage.

In order to be able to realize a connection block of small dimensions or small space requirements, it is provided according to the invention that the receptacle be formed by at least one recess.

For this purpose, in an advantageous further development of the invention, the receptacle has at least one recess, which is formed in particular in the manner of a groove.

This makes it possible to use the installation space available to the invention as efficiently as possible or to realize a modular connection housing with only a small space requirement so that the invention makes a high connection-point density possible for the conductor connection.

For this purpose, it is preferably provided that the recesses be designed corresponding to or complementary to the strip-like connecting element or its respective connecting section in such a way that in its final position the strip-like connecting element is accommodated in the recess flush with the body side.

According to the invention, the recess can be designed in a variety of ways. For this purpose, it is provided within the scope of the invention that the recess be formed in the manner of a groove for the strip-like connecting element, which extends in a lining-up direction over the connection housing side.

According to the invention, building on a preceding inventive idea, it is preferably provided that the recess be configured and formed at least in sections to form a movement guide for the strip-like connecting element, by means of which the strip-like connecting element is guided translationally, in particular linearly, for a movement between the initial position and the final position.

The recess is preferably arranged in the lining-up direction along the connection housing of a connection module so that the individual recesses, in an arrangement of the respective connection modules in order to create a connection block, thus form a continuous groove-shaped recess which extends longitudinally over the plurality of connection modules.

For a simple attachment of the connection housings to the strip-like connecting element, it is therefore provided in a further advantageous development of the invention that the respective recesses of at least two adjacent connection housings in the in-line arrangement of the connection housings be arranged in correspondence with each other, in particular aligned with each other.

It is thus possible to form a groove which extends along all of the adjacently arranged connecting housings in order to be able to connect these together in the resulting in-line arrangement in a simple manner by means of the strip-like connecting element or to be able to hold them together in the assemblage.

For a simple and cost-effective production and to favor simple handling, it is provided in a further advantageous development of the invention that the strip-like connecting element be formed in one piece.

A strip-like connecting element can thus be produced cost-effectively in a simple manner, for example by means of a stamped part, a bar profile, a strip product (metal strip, plastic strip, etc.), an extruded profile as well as an extruded body.

In addition, there are numerous other manufacturing options, so that the aforementioned examples only represent a selection of possibilities.

In order to achieve a low component weight coupled with sufficient strength, it is provided in a further advantageous development of the invention that the strip-like connecting element be formed from a plastic, in particular an insulating material, in order to be able to effectively prevent undesired electrical short circuits.

Furthermore, a strip-like connecting element can thus be produced cost-effectively and also offers possibilities for being able to produce the latching means in a correspondingly cost-effective manner. This likewise leads to good recyclability.

In order to achieve good stability and a high torsional rigidity of a connection block, it is provided within the scope of a further advantageous development of the invention that the holding means have at least two strip-like connecting elements which are arranged at a distance from each other, in particular parallel to each other and between which the connection housings are arranged.

The strip-like connecting elements are preferably arranged parallel to each other.

The connection housings are designed and adapted accordingly for the use of at least two strip-like connecting elements. They therefore likewise have corresponding receptacles on two body sides, which are preferably arranged opposite each other on the connection housing. The design of these receptacles is here analogous to the aforementioned embodiments, wherein the receptacles and also the strip-like connecting elements can be of different designs.

Preferably, however, the receptacles and also the strip-like connecting elements are of an identical design, as a result of which logistical advantages also arise in addition to handling and cost advantages.

Furthermore, it is possible within the scope of the invention for the connection housings to be designed using a uniform format, so that in particular their width is determined or dimensioned by a uniform basic dimension or a whole-number multiple of this basic dimension.

For this purpose, it is provided in a further advantageous development of the invention that at least one external dimension (length, width or depth) of each connection housing, in particular its respective width, be determined by a uniform basic dimension or a whole-number multiple of this basic dimension.

For example and in particular, the width of a connection housing is thus determined by the basic dimension in conjunction with a whole-number factor by which the basic dimension is multiplied. The width of the respective connection housing is determined in the lining-up direction in which connection housings are arranged or lined up next to each other along the strip-like connecting element.

The external dimensions are measured in orthogonal directions according to a Cartesian coordinate system on the connection housing in question. In this case, they can be determined in their respective directions by a basic dimension, wherein the values of the respective basic dimensions can be the same or different.

Against this background, the connection housings have, for example and in particular, the same width. Furthermore, the connection housings may have the same height dimension, the height being orthogonal to the width of the connection housing and being measured from one side for the conductor connection to an opposite side of the connection housing. A flat connection face can thus be formed on the connection block, which simplifies the conductor connection.

Here the invention takes into account the fact that the connection housings are designed in particular in such a way that, in the in-line arrangement in which they are held in the assemblage with each other in order to form the connection block, the connection points for the conductors lie on a plane.

Furthermore, for example and in particular, it is also provided that the connection housings have the same external dimensions, as a result of which a simple configurability of a connection block is achieved.

The attachment of a connection block to an electronic component can take place in various ways within the scope of the invention. For example, the connection housings can be configured and formed for a bonded connection, in particular by soldering, on the electronic component for the electrical contacting thereof. Furthermore, it is also possible within the scope of the invention for a connection housing to be configured and formed for a plug-in connection with the electronic component, in particular as a plug housing.

In order to simplify the assembly of the connection block on the electronic component, it is therefore provided in a further advantageous development of the invention that the connection housing be configured and formed for a plug-in connection with a socket which is arranged on the electronic component and with which the connection block can be electrically connected to the electronic component.

In this way, the connection housings of the connection modules can be connected in a simple manner to the electronic component, for example to a socket designed as a base strip, via which the electrical contacting between connection block and electronic component takes place.

On a foot section of the connection housing a base is thus formed that is configured and formed corresponding to the socket for a plug-in connection. The connection block can preferably be detached from the socket and removed without being destroyed.

This leads to the advantage that the connection block forms a plug for the conductors connected to the connection points so that the electronic component can thus be detached in a simple manner from the conductors arranged on the connection block.

For a re-mounting of this connection block on another electronic component, the effort of connecting the conductors to the connection points of the connection block is eliminated. This favors inexpensive and simple maintenance.

The connection housings are preferably arranged on one side of the strip-like connecting element and connected thereto. In a further advantageous development of the invention, the invention provides that the strip-like connecting element be configured and formed in such a way that an in-line arrangement of connection housings on one side and a further in-line arrangement on an opposite side is or can be arranged along the strip-like connecting element.

The sides of the strip-like connection element on which the connection housings are arranged are configured and formed as described above.

The invention thus makes it possible, using only one strip-like connecting element, to connect numerous connection modules in two in-line arrangements so as to form one connection block and to hold them together in an assemblage.

The two sides of the strip-like connecting element are preferably of identical design. However, the invention is not limited thereto, so that the sides can also be designed and configured differently from each other. The same applies to the connection housings of the connection modules.

The invention thus expands the advantages already mentioned above and facilitates the handling of the connection housings combined with each other to form a connection block. Furthermore, the effort and the necessary number of parts are thus kept low. Furthermore, the in-line arrangements can be arranged close to each other, as a result of which they have only a small space requirement.

The invention provides further advantages when used to form a connection on a printed circuit board. In a further advantageous development of the invention, it is provided that the electronic component be a printed circuit board or an arrangement of printed circuit boards which is preferably accommodated in an electronic housing. In this case, it is preferably possible for an in-line arrangement of the connection housings to be assigned in each case to a printed circuit board for the conductor connection. Within the scope of the invention, an electronic component can also take the form of an electronic device on which the connection block for the conductor connection is arranged. Here the electronic device can in particular be designed to be arranged on a mounting rail onto which the electronic device can preferably be snapped.

The connection block simplifies the design of a circuit board connection. Furthermore, a socket arranged on the printed circuit board can simplify the mounting of the connection block on the printed circuit board.

Furthermore, the socket can also be used for measuring purposes, for example, so that a plug of a measuring device can be inserted therein instead of the connection block.

Furthermore, a strip-like connecting element of a connection block according to the invention can form further functional elements or surfaces, such as, for example, a labeling surface to which labeling can be applied, for example also by means of a marking element.

The invention will be explained in more detail below with reference to the attached drawing, in which three exemplary embodiments as well as an arrangement of connection blocks according to the invention to an arrangement of circuit boards are shown representatively for a plurality of connection blocks according to the invention.

All of the claimed features, described features and features illustrated in the drawing form the subject-matter of the invention individually and in any combination with each other, independently of their grouping in the claims and their references, and also independently of their description or illustration in the drawing. The features are therefore not bound to the configuration explained below, but can also form a connection block according to the invention when isolated from each other as well as in a variant combination.

The figures in the drawing show possible exemplary embodiments of a connection block according to the invention in each case in a schematic representation. The illustrations in the figures are therefore in particular not necessarily to scale, so that the scales selected in each case in the figures may also differ from each other.

For greater clarity, the illustrations are reduced to the elements/components/constituent parts supporting an understanding, the same or corresponding components/constituent parts or elements being provided with the same reference numbers in the figures. For a better overview, all elements/components/constituent parts are not always provided with reference signs in the figures, wherein the assignment results from the same representation or a representation adapted to the view.

To form a conductor connection device 6, the connection block 2 according to the invention provides connection points 8 by means of the connection housings 10 to which electrical conductors can be connected in order to connect these electrically to the electronic component.

For this purpose, each connection point 8 has an electrical connection element which is accommodated in the respective connection housing 10 and which serves to electrically connect to the electronic component an electrical conductor which is connected to the connection point 8.

The connection point 8 in question is configured and formed for connecting a conductor, which is a single conductor of a cable, and in this exemplary embodiment has a conductor insertion opening 9 through which the individual conductor can be inserted into the connection housing 10 in order to be able to electrically connect the individual conductor in the interior of the connection housing 10 for example by means of a spring force clamping system. In this exemplary embodiment of a connection block 2 according to the invention, the connection points are designed in the manner of a push-in connection, but the invention is not limited to this.

Since the connection housings 10 in this exemplary embodiment are all of identical design and even the connection points 8 are of uniform design, only one connection point 8 representing the further connection points 8 is given a reference number in FIG. 1. The same applies to the conductor insertion opening 9. Furthermore, the electrical connection modules 4 as also the connection points 8 are uniformly given reference numbers 4 and 8 respectively.

The first exemplary embodiment of a connection block 2 according to the invention is also hereinafter referred to for short as connection block 2.

The connection modules 4 each have a connection housing 10, these being held together in an assemblage 14 by holding means 12. For this purpose, the connection housings 10 can be, for example and in particular, cuboid or discoid so that they can be lined up against one another. In this exemplary embodiment, the connection housings 10 are in each case cuboid.

The holding means 12 comprise two strip-like connecting elements 16, 18 of identical design between which the connection housings 10 are arranged and to which the connection housings 10 for forming the assemblage 14 are connected.

In this assemblage 14, the connection housings 10 are arranged next to each other along the strip-like connecting elements 16, 18 in an in-line arrangement 20 in a lining-up direction 22 and are held side by side by the strip-like connecting elements 16, 18.

Here the strip-like connecting elements 16, 18 are each formed as a single piece and made of an electrically insulating plastic.

In order to be able to connect the connection housings 10 together by means of the two strip-like connecting elements 16, 18, each of the connection housings 10 has a receptacle 24, 26 for each of the strip-like connecting elements 16, 18 by means of which the connection housing 10 of the respective connection module 4 is connected to the strip-like connecting elements 16, 18 by mechanical and/or frictional interlocking in order to form a firm assemblage 14 of the connection housings 10 arranged next to one another.

The aforementioned receptacles 24, 26 are given reference numbers 24, 26 only on a single connection housing 10 as representative of the further receptacles 24, 26.

The same applies to the further components of a connection housing 10 which for greater clarity are given reference numbers on a connection housing 10 as representative of the further connection housings 10.

The receptacles 24, 26 are provided on a body section 28 of the respective connection housing 10, wherein a receptacle 24 is formed on a body side 30 of the body section 28 while the further receptacles 26 are arranged on a body side 32 opposite this body side 30.

The body sides 30, 32 in the in-line arrangement 20 of the connection housings 10 face outwards in each case and transversely to the lining-up direction 22 and are thus freely accessible for mounting the strip-like connecting elements 16, 18.

In this case, the receptacle 24, 26 for arranging the connection housing 10 on the respective strip-like connecting element 16, 18 is configured and formed in such a way that the strip-like connecting element 16, 18 in question can be attached or fixed to the receptacle 24 in a direction 34, 34' transverse to the respective body side 30, 32 or transverse to the lining-up direction 22. The aforesaid direction 34, 34' is parallel to the surface normal of the body side 30, 32.

The strip-like connecting element 16, 18 has a plurality of connecting sections 36 (uniformly given reference number 36) which are arranged at equal distances from each other on the respective strip-like connecting element 16, 18. The connection sections 36 form connection places so that the connection housings 10 of the connection modules can be arranged at predetermined locations on the strip-like connecting element 16, 18.

The strip-like connecting elements 16, 18 are configured identically to each other so that for greater clarity the connecting sections 36 are identified by a reference symbol only on the strip-like connecting element 18.

For each connection housing 10 a connecting section 36 is provided on the respective strip-like connecting element 16, 18 so that the strip-like connecting elements 16, 18 each have six connecting sections 36 for the six connection housings 10 provided.

Here one connection housing 10 in each case is assigned to a connecting section 36 of the respective strip-like connecting element 16, 18 in order to connect this to the strip-like connecting element 16, 18 concerned.

Furthermore, it is provided that the respective connection section 36 and the receptacle 24, 26 of the connection housing 10 to be arranged thereon be configured and formed relative to each other for a guided translational movement in such a way that the strip-like connecting element 16, 18 and the respective connection housing 10 can be moved between an initial position, in which the respective connection housing 10 is not connected to the strip-like connecting element 16, 18, and a final position, in which the respective connection housing 10 is connected to the strip-like connecting element 16, 18. This is also illustrated by the other figures.

For this purpose, the respective receptacle 24, 26 has a recess 38 which is formed in the manner of a groove 40. For greater clarity, the recess 38 or the groove 40 are characterized as representative of the others only on one body side 30 of a connection housing 10.

For simple attachment of the strip-like connecting elements 16, 18, the respective recesses 38 of the adjacent connection housings 10 are arranged in the in-line arrangement 20 of the connection housings 10 in correspondence with each other, in particular aligned with each other.

The recesses 38 thus form a continuous groove, as a result of which it is made possible for the strip-like connecting elements 16, 18 to have no influence on the external dimensions of the connection block 2 or of the respective connection modules 2.

Here the recesses 38 are designed in such a way, corresponding to or complementary to the strip-like connecting elements 16, 18 or the relevant connecting section 36 of the respective strip-like connecting element on which the relevant connection module 4 is to be arranged, that the respective strip-like connecting element 16, 18 is accommodated in the recess 38 flush with the relevant body side 30, 32 at least in the final position.

The invention provides that the receptacle 24 of the respective connection housing 10 and/or the connecting section 36 of the respective strip-like connecting element 16, 18 has latching means 42 which are configured and formed for latching together the connection housing 10 and the strip-like connecting element 16, 18.

In this exemplary embodiment, the connecting portions 36 of the respective strip-like connecting element 16, 18 have identically formed latching means 42 (uniformly given reference number 42) which in the final position of the respective strip-shaped connecting element 16,18 latch into the recess 38 of the respective receptacle 24, 26 and, in particular, block a translational movability of the strip-like connecting element 16, 18 in the lining-up direction 22 and, in addition, by frictional interlocking prevent a movement transversely thereto. This is done by clamping forces which are created in the final position by an interaction between the strip-like connecting element 16, 18 and the relevant connection housings 10.

For greater clarity, the latching means 42 are labeled representatively only on the strip-like connecting element 18.

The latching means 42 are formed on the outer edges 44, 44' of the respective strip-like connecting element 16, 18 and are integrally formed on the connecting element 16, 18 in an elastically deformable manner.

The connection housings 10 are thus held in a combination of mechanical and/or frictional interlocking on the strip-like connecting element 16, 18 and connected thereto.

Furthermore, the aforementioned body section 28 of a connection housing 10 is formed between a head section 46, on which the connection points 8 for the conductor connection are provided, and a foot section 48 for contacting the electronic component.

Due to the same mutual orientation of the connection housings 10, the head section 46 and the foot section 48 are each labeled once as representative of the others.

For the electrical contacting of the electronic component for a plug-in connection the connection housing 10 is configured and formed with a socket which is arranged on the electronic component and via which the contacting of the electronic component takes place. For this purpose, the foot section 48 of the connection housing 10 is configured and formed as a base for a plug-in connection with the socket as is illustrated by the exemplary embodiment shown in FIG. 13.

In the context of the invention, however, it is also possible, for example, to provide soldering legs on the connection housing 10 in order to effect an electrical contacting with an electronic component.

As can be seen from FIG. 1, the connection housings 10 are configured and formed in such a way that the connection block provides the connection points 8 for the conductors in one plane. For this purpose, in this exemplary embodiment, the connection housings 10 have the same external dimensions, thereby having the same width 50, the same height 52, and the same depth 54.

FIG. 2 shows the connection block 2 with the strip-like connecting elements 16, 18 arranged in an initial position on the in-line arrangement 20.

Figure 3:
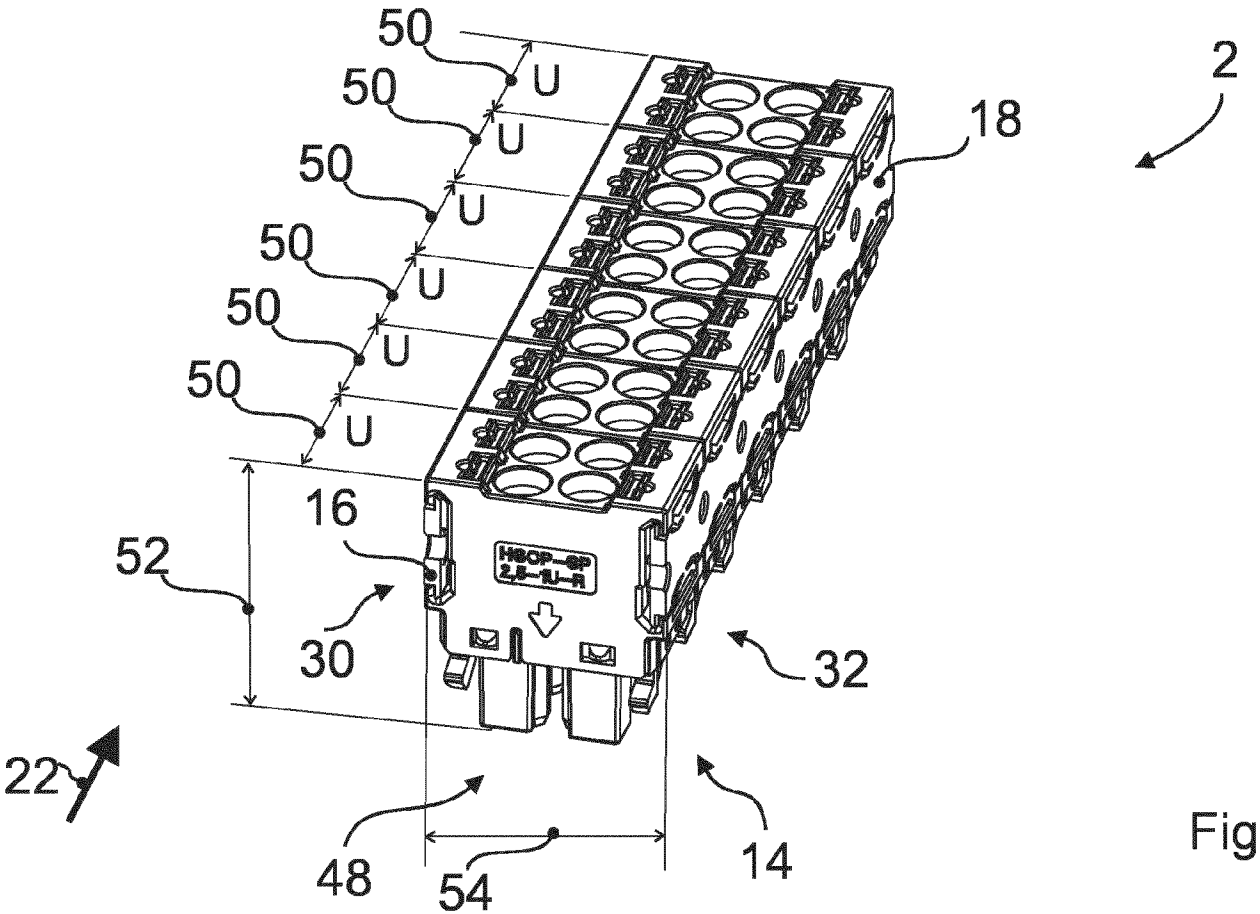

FIG. 3 shows the connection block 2 in a further perspective side view. Clear therein is that the holding means 12 have at least two strip-like connecting elements 16, 18 arranged at a distance from each other, in particular parallel to each other, between which the connection housings 10 are arranged.

The invention provides that at least one external dimension 50, 52, 54 of the respective connection housing 10 be determined by a basic dimension U. In this exemplary embodiment, the width 50 of each connection housing 10 is determined by the basic dimension U, which results in an in-line arrangement of the connection housings 10 in the lining-up direction 22.

If the connection housings 10—as in this exemplary embodiment—are arranged side by side with negligible or no spacing (spacing distance=0), the width of the connection block 2 will be determined by adding together the respective widths 50 of the connection housings 10. If, as in this exemplary embodiment, they have the same width 50, the width 50 of the connection block 2 will be determined by the number of connection housings 10 multiplied by the width 50 of one connection housing 10. In this exemplary embodiment, since the six connection housings 10 are arranged next to each other in the lining-up direction 22, the width 50 of the connection block 2 corresponds to a value equal to six times the basic dimension U and thus to 6U.

For better handling, the distances between the connection housings 10 are preferably the same, as is the case in this exemplary embodiment.

FIG. 4 shows the connection block with the strip-like connecting elements 16, 18 arranged in an initial position on the in-line arrangement 20.

Figure 5:
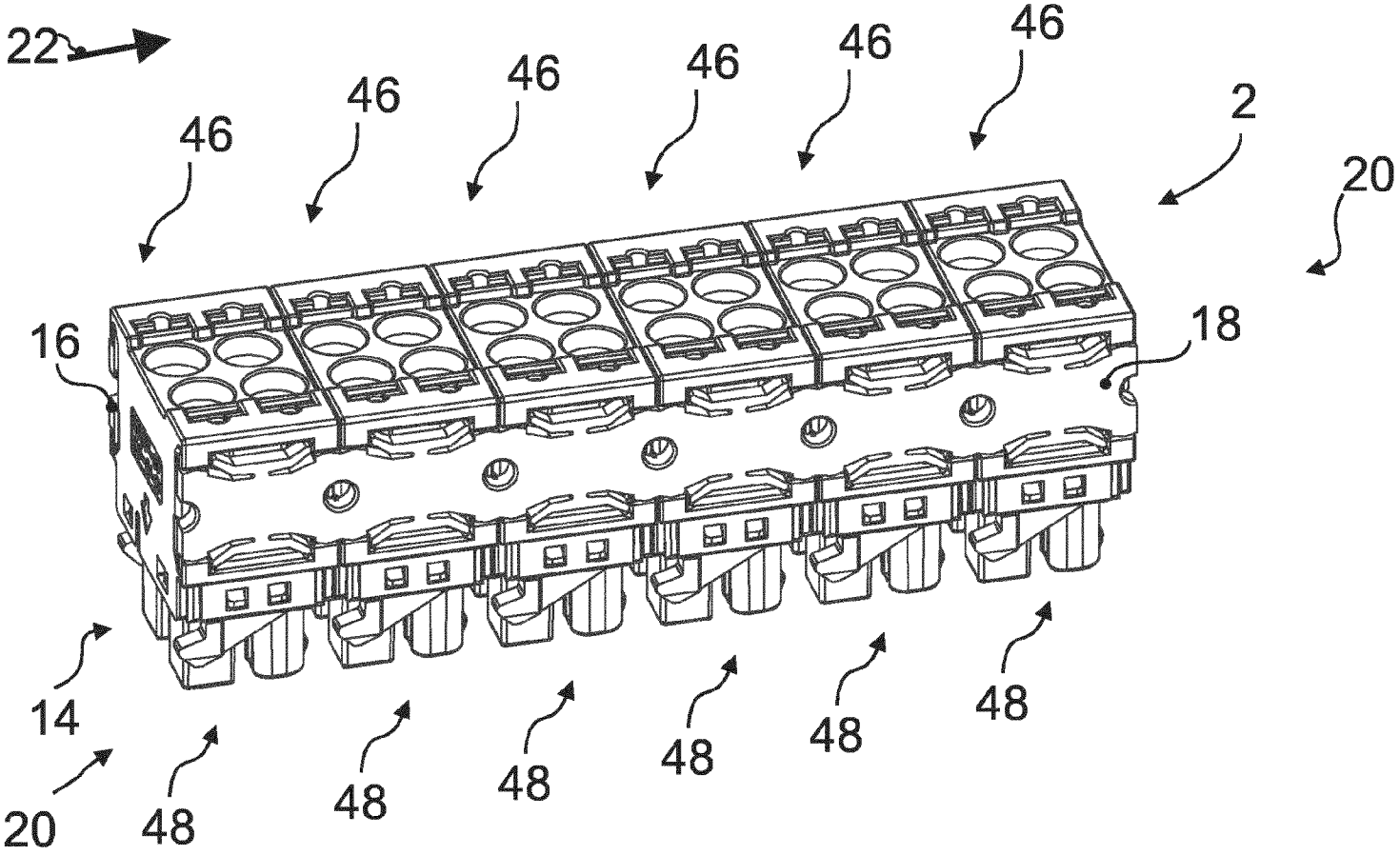

FIG. 5 shows the connection block from FIG. 4 in a further perspective side view, with the strip-like connecting elements 16, 18 arranged in a final position on the in-line arrangement 20.

In conjunction with FIG. 4, it is apparent that the invention requires a necessary path distance for a translational movement between connection housing 10 and a respective strip-like connecting element 16, 18 for a change between the initial position and the final position, said distance being less than or equal to a width 48 of a connection housing or a basic dimension U.

Figure 6:
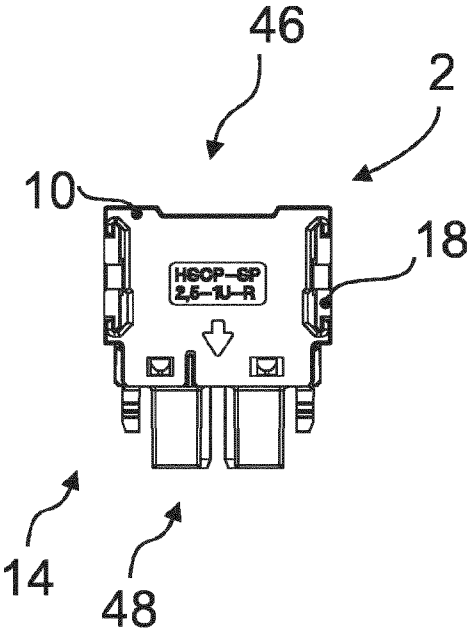
Figure 6:
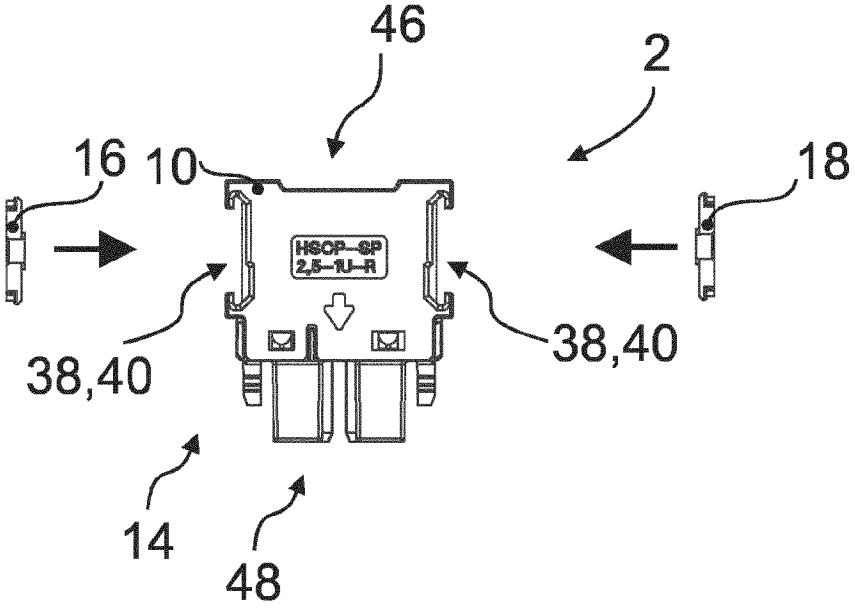

FIG. 6 *a*) shows the connection block 2 from FIG. 2, in a viewing direction indicated by A in FIG. 2, in order to make clear the attachment of the strip-like connecting elements 16, 18 to the respective receptacle 24, 26, while FIG. 6 *b*) shows the connection block from FIG. 4, in a viewing direction indicated by B in FIG. 4, whereby the arrangement can be seen at the respective connection housings 10 after attachment of the respective strip-like connecting elements 16, 18 to the respective receptacle 24, 26.

FIG. 7 shows the connection block from FIG. 1 in a further perspective side view, whereby the strip-like connecting elements 16, 18 are shown at a distance from the in-line arrangement 20.

FIG. 8 shows the connection block from FIG. 2 in a side view, which illustrates the initial position of the strip-like connecting elements 16, 18 in the in-line arrangement 20 of the connection housings 10.

FIG. 9 shows a second exemplary embodiment of a connection block 2 according to the invention in a perspective view in a schematic representation, this representation being analogous to the representation in FIG. 1.

In addition, the explanations regarding the exemplary embodiments relate to the differences from the first exemplary embodiment of a connection block 2 according to the invention.

The further exemplary embodiment of a connection block 2 according to the invention will hereinafter again be referred to for short as connection block 2.

The strip-like connecting elements 16, 18 are first shown at a distance from connecting housings 10 arranged next to each other, which form an in-line arrangement 20 for creating the connection block 2. Here the strip-like connecting elements 16, 18 are spaced parallel to each other, so that the in-line arrangement 20 of the connection housings 10 is arranged between them.

The strip-like connecting elements 16, 18 are configured identically to each other and again see latching means 42 by means of which they engage with the respective connection housings 10 in a final position illustrated in FIG. 10*b*. In contrast to the first exemplary embodiment of a connection block 2 according to the invention, the latching means 42 are arranged between the outer edges 44, 44' of the respective strip-like connecting elements 16, 18.

The respective receptacle 24, 26 of each connection housing 10 is again as a groove 40 in the connection housing 10 which in the lining-up direction 22 of the connection housing 10 extends along the respective body side 30, 32, wherein the groove 40 of a connection housing opens into the groove 40 of the adjacent connection housing 10 and is aligned flush therewith in the in-line arrangement 20. For greater clarity, the receptacles 24, 26, recesses 38 and the grooves 40 are labeled only on one connection housing 10.

The receptacle 24, 26 of each connection housing 10 and the respective strip-like connecting element 16, 18 or its respective connection section (36) are again configured and formed for a mechanically and/or frictionally interlocking connection with each other and are designed to be complementary to each other in sections.

FIG. 10*a*) shows the connection block 2 from FIG. 9 with the strip-like connecting elements 16, 18 arranged in an initial position on the in-line arrangement 20.

FIG. 10*b*) shows the connection block 2 from FIG. 9 with the strip-like connecting elements 16, 18 arranged in a final position on the in-line arrangement 20 in which the strip-like connecting elements 16, 18 hold the connection housings 10 together in the assemblage 14.

FIG. 11 shows a third exemplary embodiment of a connection block 2 according to the invention having a plurality of in-line arrangements 20, 20', 20" of connection housings 10 in a perspective view in a schematic representation, wherein the strip-like connecting elements 16, 18, 56, 58 used are shown spaced apart from the connection housings 10 arranged in three in-line arrangements 20, 20', 20".

Two strip-like connecting elements 16, 18 are used to form the connection block 2 in which connection housings 10 are arranged on one side 60 of the strip-like connecting element 16, 18.

This exemplary embodiment of a connection block 2 according to the invention additionally uses two further strip-like connecting elements 56, 58 which are each configured and formed such that an in-line arrangement 20, 20' of connection housings 10 on one side 60 and a further in-line arrangement 20', 20" on a side 62 opposite this side 60 can be or is arranged along the strip-like connecting element (16, 18).

The strip-like connecting elements 56, 58 are therefore in each case connected to two in-line arrangements 20', 20', 20" of connection housings 10, while the strip-like connecting elements 16, 18 in each case connect only one in-line arrangement 20', 20" of connection housings 10, as shown in FIG. 12.

FIG. 12 shows the connection block 2, wherein the strip-like connecting elements 16, 18, 56, 58 are arranged in a final position on the connection housings 10 and the connection housings 10 are connected to each other via the strip-like connecting elements 16, 18, 56, 58.

FIG. 13 an exemplary embodiment with connection blocks 2 according to the invention, which are to be inserted in sections into an electronic housing 64 in which in each case an electronic component 66 is accommodated and from which they are spaced apart in FIG. 13.

The electronic component 66 is symbolized by reference number 66 and is formed by an arrangement of printed circuit boards which in this exemplary embodiment are arranged parallel to each other.

The two connection blocks 2 are spaced apart from the electronic component 66 on which a socket 70 for the connection block 2 and a further socket 70' for the further connection block 2 are provided on an outer side 68.

The socket 70' is formed from individual sockets 70", 70'", 70"", wherein in each case one of the sockets 70", 70'", 70""" is disposed on a circuit board. The socket 70', into which the one connection block 2 can be inserted, is formed by the arrangement of the circuit boards.

A further socket 70 into which the further connection block 2 can be inserted is arranged on a further circuit board of the arrangement of circuit boards.

In this case, the one connection block 2 is formed in the manner of a first exemplary embodiment and the further connection block 2 is formed in the manner of a third exemplary embodiment.

The connection housings 10 of the respective connection block 2, 2' are set up and designed for a plug-in connection with the respective socket 70, 70'.

The electronics housing 64 is formed and configured to be arranged on a mounting rail 72.

The invention is not limited to the embodiments described above and illustrated with reference to the figures.

The connection housings 10 can thus, for example, also be designed differently from each other. Furthermore, it is possible for the strip-like connecting elements 16, 18, 56, 58 used to be designed differently from each other.

Furthermore, a connection block 2 according to the invention is suitable, for example and in particular, for forming a circuit board connection device on one or on an arrangement of circuit boards. For example, individual conductors can be connected to the connection block 2 and electrically connected via this to a particular printed circuit board.

This results in a wide range of design options and fields of application for a connection block 2, 2' formed according to the invention.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

Modular connection block 2
Connection module 4
Conductor connection device 6
Connection points 8
Conductor insertion opening 9
Connection housing 10
Holding means 12
Assemblage 14
Strip-like connecting element 16, 18
In-line arrangement 20, 20', 20"
Lining-up direction 22
Receptacle 24, 26
Body section 28
Body side 30, 32

Direction transverse to the body side 34, 34'
Connecting section 36
Recess 38
Groove 40
Latching means 44, 44'
Outer edges of the strip-like connecting element 46
Head section 48
Foot section 50
Width of a connection housing 52
Height of a connection housing 54
Depth of a connection housing 56, 58
Strip-like connecting element (mountable on two sides) 60
One side of the strip-like connecting element 62
Further side of the strip-like connecting element 64
Electronics housing 66
Electronic component 68
Outside of the electronics housing 70, 70', 70", 70''' 70''''
Socket 72
Mounting rail U
Basic dimension

The invention claimed is:

1. A modular connection block, comprising:

a plurality of electrical connection modules for conductor connection to an electronic component, the connection modules, in each case having a connection housing, being held together by holding means in an assemblage, wherein the holding means comprise at least one strip-like connecting element, by which the connection housings are connected, the connection housings being arranged side by side along the strip-like connecting element in an in-line arrangement, wherein the strip-like connecting element comprises a plurality of spaced-apart connecting sections, from whose arrangement connection places are predetermined on the strip-like connecting element at which a respective connection module is connected or connectable to the strip-like connecting element by mechanical and/or frictional interlocking, wherein the connection housing comprises at least one receptacle for the strip-like connecting element, wherein the receptacle and the strip-like connecting element are configured and formed in such a way that the connection housing is connected or is connectable to the strip-like connecting element, and wherein the connecting section and the receptacle are configured for a translational movement of the connection housing and the strip-like connecting element relative to each other between an initial position, in which the respective connection housing is not connected to the strip-like connecting element, and a final position in which the respective connection housing is connected to the strip-like connecting element.

2. The modular connection block according to claim 1, wherein the receptacle is arranged on a body side of the connection housing.

3. The modular connection block according to claim 2, wherein the receptacle is configured such that the strip-like connecting element is attachable to the receptacle in a direction transverse to the body side for an arrangement of the connection housing on the strip-like connecting element.

4. The modular connection block according to claim 1, wherein the connecting sections are spaced at equal distances from each other.

5. The modular connection block according to claim 1, wherein the receptacle of the connection housing and/or the connecting section of the strip-like connecting element comprises/comprise latching means configured to latch together the connection housing and the strip-like connecting element.

6. The modular connection block according to claim 1, wherein the receptacle has at least one recess, the at least one recess comprising a groove.

7. The modular connection block according to claim 6, wherein respective recesses of at least two adjacent connection housings are arranged to correspond to each other so as to align with each other.

8. The modular connection block according to claim 1, wherein the strip-like connecting element is formed in one piece.

9. The modular connection block according to claim 1, wherein the strip-like connecting element comprises a plastic, the plastic comprising an insulating material.

10. The modular connection block according to claim 1, wherein the holding means comprise at least two strip-like connecting elements arranged at a distance from each other, so as to be parallel to each other, between which the connection housings are arranged.

11. The modular connection block according to claim 1, wherein at least one external dimension of each connection housing, comprising a width, is determined by a basic dimension or a whole-number multiple of the basic dimension.

12. The modular connection block according to claim 1, wherein the connection housing is configured for a plug connection with a socket.

13. The modular connection block according to claim 1, wherein the strip-like connecting element is configured such that an in-line arrangement of connection housings on one side and a further in-line arrangement is arranged or arrangeable along the strip-like connecting element on a side opposite this side.

14. The modular connection block according to claim 1, wherein the electronic component comprises a printed circuit board or an arrangement of printed circuit boards.

15. A modular connection block, comprising:

a plurality of electrical connection modules for conductor connection to an electronic component, the connection modules, in each case having a connection housing, being held together by holding means in an assemblage, wherein the holding means comprise at least one strip-like connecting element, by which the connection housings are connected, the connection housings being arranged side by side along the strip-like connecting element in an in-line arrangement, wherein the strip-like connecting element comprises a plurality of spaced-apart connecting sections, from whose arrangement connection places are predetermined on the strip-like connecting element at which a respective connection module is connected or connectable to the strip-like connecting element by mechanical and/or frictional interlocking, and wherein the strip-like connecting element is configured such that an in-line arrangement of connection housings on one side and a further in-line arrangement is arranged or arrangeable along the strip-like connecting element on a side opposite this side.

16. The modular connection block according to claim 15, wherein the electronic component comprises a printed circuit board or an arrangement of printed circuit boards.

17. The modular connection block according to claim 15, wherein the strip-like connecting element is formed in one piece.

18. The modular connection block according to claim 15, wherein the strip-like connecting element comprises a plastic, the plastic comprising an insulating material.

* * * * *